United States Patent [19]

Gamell

[11] 3,967,914

[45] July 6, 1976

[54] POWER GENERATING SYSTEM

[75] Inventor: Joseph A. Gamell, Kalamazoo, Mich.

[73] Assignee: Joseph Gamell Industries, Incorporated, Kalamazoo, Mich.

[22] Filed: Jan. 6, 1975

[21] Appl. No.: 538,527

Related U.S. Application Data

[60] Continuation-in-part of Ser. No. 402,064, Oct. 1, 1973, abandoned, which is a division of Ser. No. 196,478, Nov. 8, 1971, Pat. No. 3,800,528.

[52] U.S. Cl. ..... 415/90; 415/71; 415/76

[51] Int. Cl.[2] ..... F04D 19/00

[58] Field of Search ..... 415/74, 75, 76, 90, 415/73

[56] References Cited

UNITED STATES PATENTS

| | | | |
|---|---|---|---|
| 68,325 | 8/1867 | Welham | 415/90 |
| 158,579 | 1/1875 | Fairfax | 415/76 |
| 551,853 | 12/1895 | Desgoffe | 415/74 |
| 778,928 | 1/1905 | Webb | 415/75 |
| 981,311 | 1/1911 | Rivers | 415/73 |
| 2,325,530 | 7/1943 | Meredith | 415/90 |

*Primary Examiner*—Henry F. Raduazo
*Attorney, Agent, or Firm*—Gordon W. Hueschen

[57] ABSTRACT

A power generating system which includes a turbine and a radiant heat boiler for supplying motive fluid to the turbine. The turbine is provided with a stator having a cylindrical bore and a cylindrical rotor provided with a substantially uniformly rough lateral surface. The inner wall of the turbine stator is provided with a continuous oblique helical groove which serves as a passageway for the motive fluid. The lateral surface of the rotor has a relatively high drag coefficient and the rotor is actuated to a high rotational speed by the motive fluid flowing in the stator passageway and past the rotor lateral surface. The radiant heat boiler comprises a hermetically sealed enclosure having a substantially globular inner surface covered with radiant heat reflecting surfaces, a substantially globular pressure vessel centrally situated within the enclosure and spaced apart from the reflecting surfaces about its entire periphery, a radiant heat source mounted within the space between the reflecting surfaces and the pressure vessel.

14 Claims, 4 Drawing Figures

POWER GENERATING SYSTEM

CROSS REFERENCE TO RELATED APPLICATIONS

This application is a continuation-in-part of the application Ser. No. 402,064, filed Oct. 1, 1973, now abandoned which is a division of application Ser. No. 196,478, filed Nov. 8, 1971; now U.S. Pat. No. 3,800,528.

BACKGROUND OF THE INVENTION

This invention relates to prime movers actuated by a motive fluid, usually in a gaseous form.

Various types of rotor designs for turbines and the like are known in the art; however, most such designs require rather intricate configurations for the rotor elements thereby making it difficult to balance the rotor so as to avoid the generation of vibrations during high speed rotation of the turbine rotor. In addition, prior art turbine rotors are expensive to manufacture.

It has been proposed to pass motive fluid over the surface of a cylindrical rotor in a helical path and to rely upon the friction between the fluid and the rotor to effect the desired rotation.

It is an object of the present invention to provide an improved turbine of the last mentioned design, especially one in which there is provided a high degree of turbulence at the interface between the motive fluid and the rotor surface.

Another object of this invention is to provide an efficient radiant heat boiler which serves as motive fluid source for the turbine.

Yet another object is to provide a power generating system which is efficient and easy to maintain.

Still other objects will readily present themselves to one skilled in the art upon reference to the ensuing specification, the accompanying drawings, and the claims.

SUMMARY OF THE INVENTION

The present invention contemplates a power generating system which includes a turbine and a radiant heat boiler.

The turbine comprises a stator having a cylindrical bore, a cylindrical rotor coaxially journalled in the stator and provided with a substantially uniformly rough surface having a relatively high drag coefficient. An output shaft is secured to the rotor and projects axially from one end thereof. The turbine stator is provided with a motive fluid inlet port which is substantially tangential to the lateral surface of the rotor near one end of the rotor and with a motive fluid outlet port near the other end of the rotor, and the inner wall of the turbine stator is provided with a continuous oblique helical groove over that portion of the inner wall which is coextensive with the lateral surface of the turbine rotor. One end of the helical groove communicates with the inlet port and the other end of the groove communicates with the outlet port.

The radiant heat boiler of this system comprises a hermetically sealed enclosure having a substantially globular inner surface with radiant heat reflecting surfaces covering the inner surface, a substantially globular pressure vessel centrally situated within the enclosure and spaced apart from the reflecting surfaces about its entire periphery and a radiant heat source within the space between the reflecting surfaces and the pressure vessel, said pressure vessel being provided with fluid inlet means and fluid outlet means projecting through the enclosure.

The motive fluid circulates within the system in a closed loop. That is, the fluid outlet means of the pressure vessel communicates with the motive fluid inlet port of the turbine stator and the motive fluid outlet port of the turbine stator communicates with the fluid inlet means of the pressure vessel.

DESCRIPTION OF THE PREFERRED EMBODIMENTS

Figure 1:
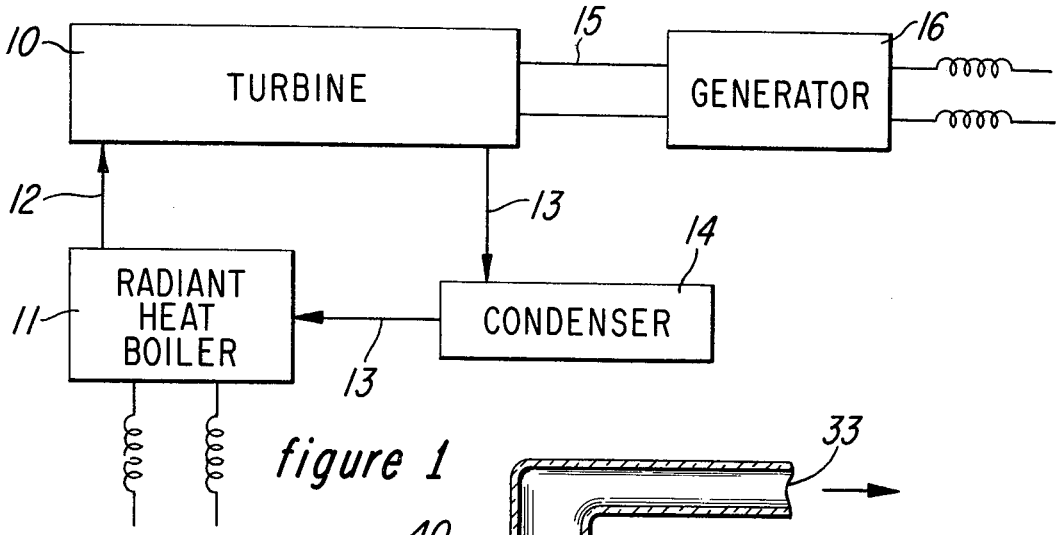
FIG. 1 is a block diagram showing one embodiment of the power generating system of this invention.

Referring to FIG. 1, source of motive fluid for turbine 10 is radiant heat boiler 11 which can be fired by any suitable radiant heat source. The motive fluid is transferred from radiant heat boiler 11 to turbine 10 via conduit or line 12 and returned from turbine 10 to radiant heat boiler 11 via line 13. If desired, condenser 14 can be provided in line 13 to assist in condensation of the motive fluid for reuse; however, if the boiling point of the particular motive fluid that has been selected is sufficiently high, condensation can take place in line 13 without the need for an auxiliary condenser. Cooling fins can be provided on line 13 for that purpose, if desired. Turbine output shaft 15 can be connected to electrical generator 16 or to any other power takeoff means.

Figure 3:
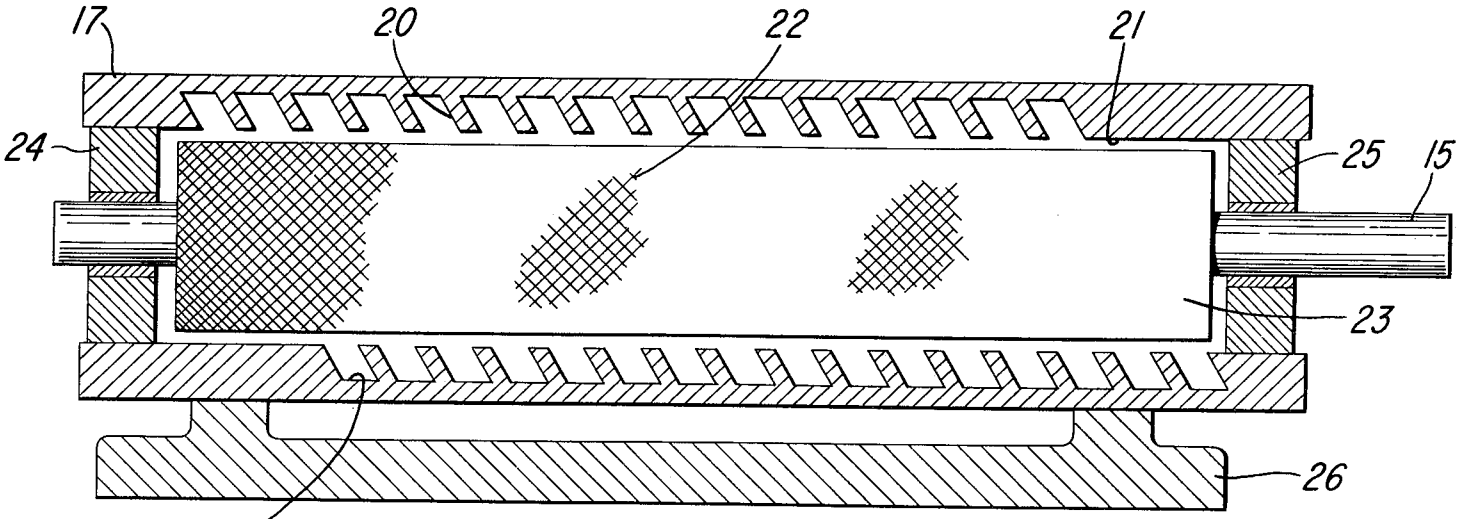
FIG. 3 is a sectional side elevation of the turbine shown in FIG. 2 taken along line III—III.
Figure 2:
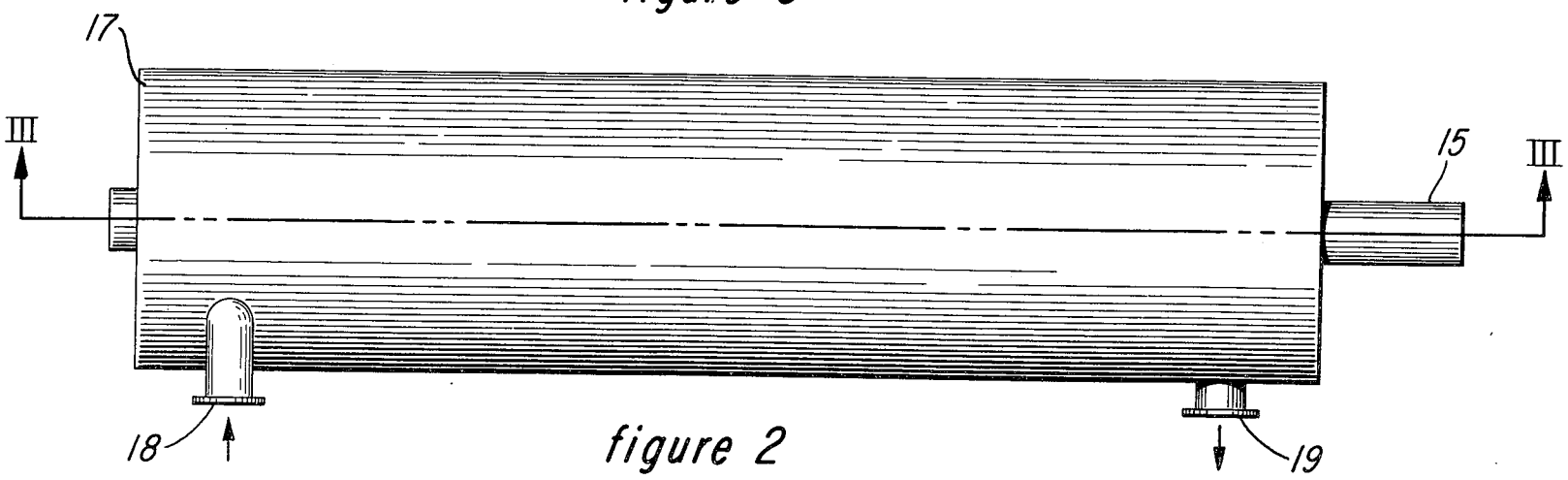
FIG. 2 is a top view of a turbine of this invention.

As shown in FIG. 2, turbine stator 17 can also serve as a casing for the turbine. Stator 17 is provided with motive fluid inlet port 18 and motive fluid outlet port 19. Both inlet port 18 and outlet port 19 communicate with a continuous oblique helical groove 20 in the inner wall of stator 17 (FIG. 3). Groove 20 can be machined into the wall of cylindrical stator bore 21 or a separate oblique helix can be inserted in bore 21 and then secured in place so as to become part of the stator inner wall.

The oblique helical groove 20 is substantially coextensive with lateral surface 22 of turbine rotor 23, and one end of groove 20 communicates with inlet port 18 and the other end of groove 20 communicates with outlet port 19.

Rotor 23 of the turbine has a cylindrical configuration and is journalled within cylindrical bore 21 of stator 17 by means of suitable bearings 24 and 25. Output shaft 15 is secured to rotor 23 and projects axially from one end of the rotor.

Lateral surface 22 of rotor 23 has a relatively high drag coefficient vis-a-vis the motive fluid; that is, lateral surface 22 is substantially uniformly rough. Lateral surface 22 can be knurled, or the like, or can be provided with a plurality of closely-spaced blind holes over the surface area.

The relative dimensions of rotor 23 and stator bore 21 are chosen so that the clearance between the stator inner wall and the rotor is very small, usually of the order of about 0.01 inch for efficient operation.

Motive fluid inlet port 18 is situated in turbine stator 17 near one end of rotor 23 and preferably is substantially tangential to lateral surface 22 of turbine rotor 23 so that a relatively high-velocity stream of the motive fluid can be passed through the oblique helical groove 20 in close proximity to lateral surface 22.

Turbine stator 17 can be supported on a suitable cradle or support such as turbine bed 26.

When the motive fluid enters inlet port 18, it sweeps across the back part of the rotor, down to the first groove in the bottom of the housing and then back up across the rotor to the second groove at the top of the housing. Thus, it sweeps diagonally down across the back face and diagonally back up across the front face. The sweep of the gas in each convolution covers more surface than it would were the helical grooves machined on a right helix. This sweeping back and forth across the rotor, especially if it has a knurled surface, generates a degree of turbulence not heretofore obtained. This turbulence increases the friction or drag on the rotor and thus increases the efficiency of the turbine.

An oblique helical groove as the term is used herein refers to a groove machined on an oblique helix, which is to say on a helix, each convolution of which is canted at an oblique angle to the axis of the helix. The helical groove 20 is like the grooves of a female thread except that each convolution is canted at an oblique angle to the axis.

In the form shown in FIG. 3, the oblique angle is approximately 65° to the axis. In other words, it is canted about 25° from the normal or 90° position characteristic of a right or normal helix. The angle is determined by the line connecting the mid-point of the first bottom groove the 180° point of the first convolution to the mid-point between the first two top grooves (the zero degree and the 360° points, respectively, of the first convolution). If the helical groove were a right helical groove, such a line would be normal to the axis of the helix. In the modification shown in FIG. 3, such a line is about 65° to the axis or canted about 25° from the normal.

The advantages of the invention are obtained with any degree of canting but become more pronounced as the degree of canting is increased. Advantageously, the canting is at least 15° to the normal (75° to the axis) up to about 35° (55° to the axis). Any greater degree of canting is undesirable because it unnecessarily extends the length of the turbine. A canting of about 25° is optimal when the surface 22 is knurled.

The oblique angle may slope to the left as shown in FIG. 3 or it may slope to the right. The direction in which the helix is canted is not the important thing. The important thing is the fact that when it is canted the gas sweeps across one face of the rotor and then back over the other face at a substantial angle and thereby creates the turbulence noted above.

Figure 4:
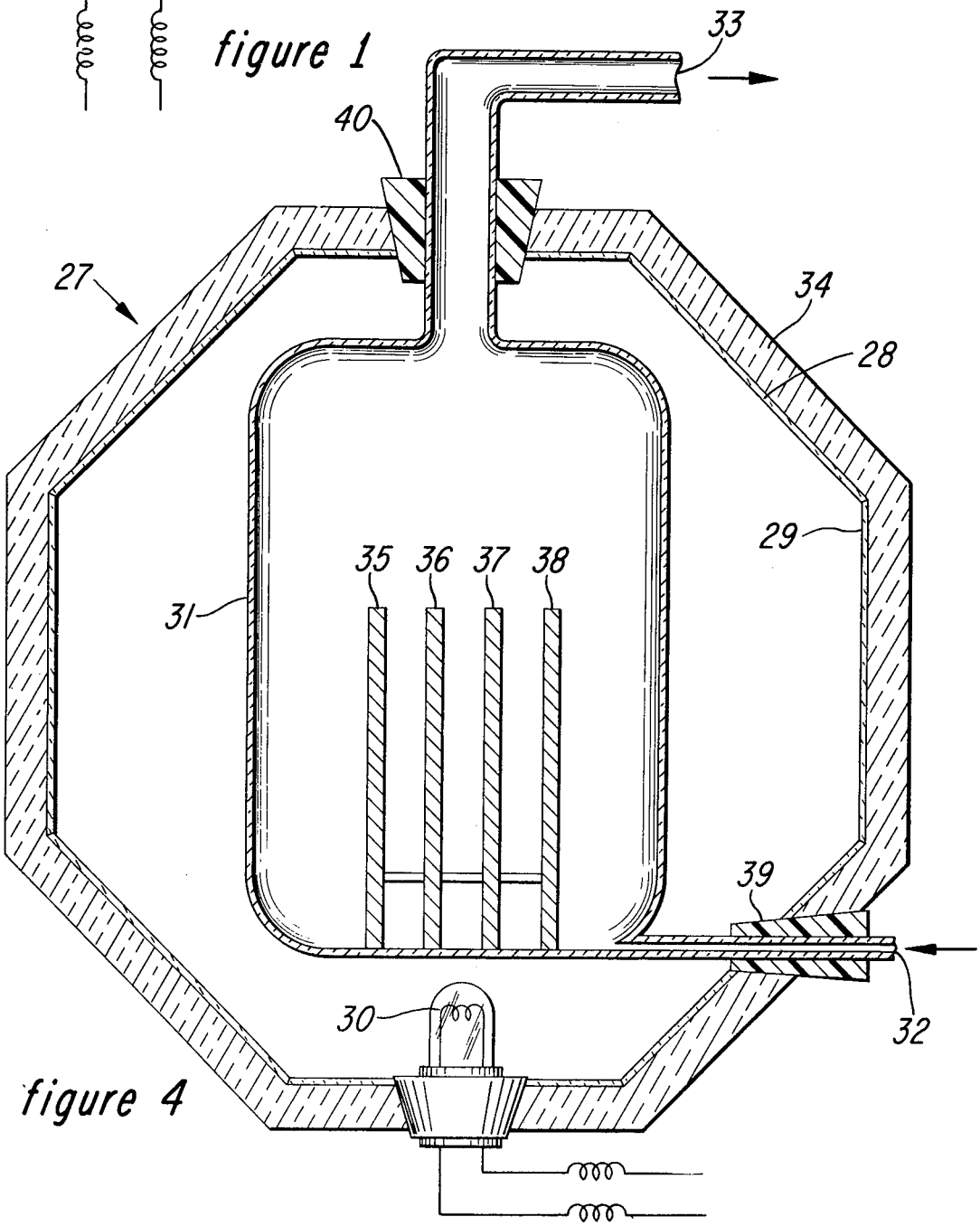
FIG. 4 is a sectional side elevation of an embodiment of a radiant heat boiler of this invention.

Radiant heat boiler 27 suitable for use in the present power generating system is shown in FIG. 4. Boiler 27 comprises hermetically sealed polyhedral enclosure 28 provided with heat-reflecting surfaces or mirrors 29, radiant heat source 30, and pressure vessel 31 adapted to receive and dispense a motive fluid through fluid inlet 32 and fluid outlet 33, respectively. Fluid inlet 32 and fluid outlet 33 are mounted in the walls of enclosure 27 by means of insulating seals 39 and 40, respectively, and can also serve to hold vessel 31 in a central position within enclosure 27. The polyhedral enclosure can have any number of reflecting surfaces 29 up to an infinite number in which event the polyhedral enclosure is a sphere.

Radiant heat source 30 can be a halogen lamp, or the like. Halogen lamps are tungsten filament lamps filled with iodine vapor or other halogen and most often housed in a quartz envelope. They have the advantage over the ordinary tungsten filament lamps, or the so-called incandescent lamps, in that the tungsten filament does not deteriorate. The lamp, therefore, can be operated at a higher temperature resulting in a shifting of the spectrum toward the blue end so that relatively little infrared is produced.

The radiant heat source 30 is mounted within enclosure 27 so that the radiant heat therefrom is directed to pressure vessel 31 either directly or reflected by means of mirrors 29. A plurality of radiant heat sources can also be employed, if desired. As shown in FIG. 4, radiant heat source 30 is mounted in a wall of polyhedral enclosure 27; however, the radiant heat source, or sources, can be suspended within the enclosure so as to minimize heat loss to the surroundings by conduction, if desired.

Also, in order to minimize heat losses, polyhedral enclosure 27 can be provided with heat-insulating layer 34 on the outside thereof. Suitable materials for this purpose are ceramic foams, polyurethane foam, styrofoam, and the like. In order to reduce heat losses due to gas convection and conduction within the enclosure, preferably enclosure 27 is maintained at a subatmospheric pressure. More preferably enclosure 27 is evacuated and vacuum is maintained therein.

Pressure vessel 31, containing the motive fluid, is centrally situated within polyhedral enclosure 27. Vessel 31 can be transparent or opaque, depending upon the heat absorptive characteristics of the motive fluid. Preferably vessel 31 is provided with radiant heat absorbing surfaces which can constitute the outer shell of vessel 31 or which can be in the form of heat absorptive plates such as metal plates 35, 36, 37, and 38 situated within a transparent vessel.

The radiant energy from lamp 30 is reflected randomly within the enclosure and eventually converted into heat in or on the surface of the pressure vessel 31. If the outer shell of the pressure vessel 31 is transparent, the radiation passes through and is absorbed by the motive fluid or by the accumulator plates 35, 36, 37, and 38 and there converted into heat. This is a typical greenhouse effect. If the outer shell of the pressure vessel 31 is opaque and absorbent to the radiant heat energy, the radiation will be absorbed in it and there converted to heat. In either case, and particularly when the outer shell of the vessel 31 is transparent, the amount of heat dissipated in the space between the vessel 31 and the reflecting surfaces is minimal. There is thus provided an efficient radiant heat boiler in which the heat losses are small and the amount of insulation needed on the surface of the enclosure is correspondingly small.

Any suitable motive fluid that can be readily vaporized and condensed can be employed. Typical of such fluids, and preferred for the purposes of this invention, are halogenated hydrocarbons such as trichloromonofluoromethane (Freon 11), dichloromonofluoromethane (Freon 21), dichlorotetrafluoroethane (Freon 114), trichlorotrifluoroethane (Freon 113), and the like. Other motive fluids such as water, or the like, can also be used.

In operation the motive fluid in liquid form is converted into gaseous form in radiant heat boiler 27. A relatively high velocity gas stream emanating from boiler 27 is then introduced into helical groove 20 of turbine stator 17. As the gas stream speeds along the passageway defined by groove 20, the gas stream brushes past the rough lateral surface 22 of turbine rotor 23 and, because of the drag characteristics thereof, imparts relatively high rotational speed and torque to rotor 23. The spent motive fluid is condensed upon leaving turbine 10 and is returned to radiant heat boiler 27 for reuse.

The foregoing disclosure and the accompanying drawings are illustrative of the present invention but are not to be construed as limiting. Still other variations and rearrangements of parts within the spirit and scope of the present invention are possible and will readily present themselves to the skilled artisan.

I claim:

1. A turbine comprising a stator having a cylindrical bore;

a cylindrical rotor coaxially journalled in said stator and provided with a substantially uniformly rough lateral surface; and an output shaft secured to the rotor and projecting axially from one end of the rotor;

said stator being provided with a motive fluid inlet port near one end of the rotor and with a motive fluid outlet port near the other end of the rotor; and the inner wall of said stator being provided with a continuous oblique helical groove over that portion of the inner wall which is coextensive with the lateral surface of the rotor, one end of said groove communicating with said inlet port and the other end of said groove communicating with said outlet port.

2. The turbine of claim 1 wherein each helical convolution is canted about 15° to 35° to the normal.

3. The turbine of claim 2 in which each helical convolution is canted about 25° to the normal.

4. The turbine of claim 2 wherein the lateral surface of the rotor is knurled.

5. The turbine of claim 3 in which the lateral surface of the rotor is knurled.

6. The turbine of claim 1 wherein the motive fluid inlet port is situated substantially tangential to the lateral surface of the rotor.

7. The turbine of claim 1 wherein each helical convolution is canted toward the motive fluid inlet port whereby the motive fluid entering the inlet port sweeps across one face of the rotor at a substantial angle away from the inlet and then back across the opposite face of the rotor, at essentially the same angle toward the inlet.

8. The turbine of claim 7 wherein each helical convolution is canted at an angle of 15° to 35° to the normal.

9. The turbine of claim 7 wherein each helical convolution is canted at an angle of about 25° to the normal.

10. The turbine of claim 9 wherein the lateral surface of the rotor is knurled.

11. In a turbine comprising a stator having a cylindrical bore;

a cylindrical rotor coaxially journalled in said stator and provided with a substantially uniformly rough lateral surface; and an output shaft secured to the rotor and projecting axially from one end of the rotor;

said stator being provided with a motive fluid inlet port near one end of the rotor and with a motive fluid outlet port near the other end of the rotor; and the inner wall of said stator being provided with a continuous helical groove over that portion of the inner wall which is coextensive with the lateral surface of the rotor, one end of said groove communicating with said inlet port and the other end of said groove communicating with said outlet port, the improvement wherein the helical groove comprises a plurality of sequentially connected convolutions of 360° each, which are characterized in that the line connecting the 180° point in any one convolution to the mid-point between the zero degree point and the 360° point of the same convolution is canted to the normal.

12. The turbine of claim 11, in which the said line is canted toward the motive fluid inlet port, whereby the motive fluid entering the inlet port sweeps down across one face of the rotor substantially at the angle of the cant and away from the inlet, and then back across the opposite face of the rotor at substantially the angle of the cant.

13. The turbine of claim 12, in which the angle of the cant is about 15° to 35° to the normal.

14. The turbine of claim 13, in which the angle of the cant is about 25° to the normal.

* * * * *